US006658912B1

(12) United States Patent
Flehmig et al.

(10) Patent No.: US 6,658,912 B1
(45) Date of Patent: Dec. 9, 2003

(54) BENDING BLOCK FOR A BENDING DEVICE

(75) Inventors: Thomas Flehmig, Ratingen (DE); Uwe Kneiphoff, Dinslaken (DE); Klaus Blümel, Dinslaken (DE); Klaus Göhler, Duisburg (DE)

(73) Assignee: Thyssen Krupp Stahl AG, Dusseldorf (DE)

( * ) Notice: Subject to any disclaimer, the term of this patent is extended or adjusted under 35 U.S.C. 154(b) by 2 days.

(21) Appl. No.: 09/979,448

(22) PCT Filed: May 16, 2001

(86) PCT No.: PCT/EP00/04361

§ 371 (c)(1),
(2), (4) Date: Feb. 27, 2002

(87) PCT Pub. No.: WO00/76683

PCT Pub. Date: Dec. 21, 2000

(30) Foreign Application Priority Data

Jun. 9, 1999 (DE) ..... 199 26 330

(51) Int. Cl.[7] ..... B21D 9/01
(52) U.S. Cl. ..... 72/466.2; 72/150
(58) Field of Search ..... 72/150, 369, 466, 72/466.2

(56) References Cited

U.S. PATENT DOCUMENTS

| | | | | |
|---|---|---|---|---|
| 304,639 A | * | 9/1884 | Grimmett et al. | 72/466 |
| 1,654,697 A | * | 1/1928 | Mueller et al. | 72/466 |
| 5,735,160 A | | 4/1998 | VanSumeren et al. | |

FOREIGN PATENT DOCUMENTS

| | | |
|---|---|---|
| CH | 604946 | 9/1978 |
| DE | 19707228 | 8/1998 |
| GB | 1574445 | 9/1980 |
| GB | 2148758 A | 6/1985 |
| JP | 6198349 | 7/1994 |

* cited by examiner

*Primary Examiner*—Lowell A. Larson
(74) *Attorney, Agent, or Firm*—Proskauer Rose LLP

(57) ABSTRACT

The invention relates to a bending mandrel for a bending device and also to a bending method for pipes, more particularly pipes which have a large diameter-to-wall thickness ratio and are to be bent by a small radius, for example, of the order of magnitude of the pipe diameter. To this end use is made of a bending mandrel (5, 6) to whose rigid head (5) assembly (6) of springy sheet metal lamellae (6*a*, 6*b*) is attached to improve the bendability of the bending mandrel (5, 6) while maintaining a satisfactory supporting action, the lamellae (6*a*), with the exception of the outer lamellae (6*b*), having window-like cutaway portions (6*c*).

11 Claims, 5 Drawing Sheets

BENDING BLOCK FOR A BENDING DEVICE

BACKGROUND OF THE INVENTION

The invention relates to a bending mandrel for a bending device for pipes, comprising a rigid head and, attached thereto by only one end, an assembly of flexible lamellae which are layered one above the other and can be bent towards one another perpendicularly of the plane of the lamellae, accompanied by the sliding of the lamellae.

Bending mandrels of the kind specified are used in bending devices for pipes, to support the pipe from inside during the bending operation. Such support is required to counteract any kinking of the pipe, corrugation at the inner bending arc, flattenings at the outer arc, oval deformation of the cross-section and any springing back of the pipe after the bending operation. The risk that the aforementioned events may take place with the bending mandrel not inserted is particularly great in the case of pipes having a high external diameter/wall thickness ratio and required to be bent by a comparatively small radius, for example of the order of magnitude of the pipe diameter. Typical wall thicknesses of such pipes are, for example, 1.5 mm with a pipe diameter of 150 mm.

The prior art discloses different kinds of bending mandrels with which it is not possible to obviate all the aforementioned disadvantages.

In a bending mandrel taking the form of a jointed mandrel (DE 197 07 228 A1) a number of solid links are disposed in series on a rigid head and jointably connected to one another. The joints are formed by link surfaces sliding one upon the other, the surface of one link being constructed convex and the surface of the other link concave. It is true that with such a bending mandrel the circular cross-section of the pipe supported thereon is maintained during the bending operation in the zone of each link, due to the solid construction of the links, but this does not take place over the entire axial length of the arc. The reason is that due to the convex (spherical) shape of the links, the pipe is supported only at axially offset narrow annular zones. In the unsupported zones, therefore, the pipe may become undesirably deformed by either flattenings or folding.

Such undesirable deformation of the pipe during bending is intended to be obviated by another known solid inner mandrel (EP 0 856 367 A2). In this case the bending mandrel is made of plastics (polyurethane) and is solid in construction. The disadvantage of such a bending mandrel is on the one hand that the bendability of a solid bending mandrel is inadequate for bending pipes with small radii of bending, while on the other hand for supporting purposes a compromise must be reached between the bendability of the bending mandrel and stability of shape. If high stability of shape is to be ensured, heavy bending forces must be exerted. The bending force must be greater in proportion as the pipe diameter increases. Clearly, for this reason limits are quickly reached in the use of such a mandrel for pipes of large diameter.

Lastly, a bending mandrel of the kind specified is known (JP 619 8349) in which an assembly of flexible plastics lamellae layered one above the other is disposed between outer spring steel plates bearing against the inside of the pipe. Since the individual lamellae can slide on one another the bending force to be exerted for the bending operation is lower in comparison with the other bending mandrel of solid plastics material. Nevertheless, the bending force to be exerted is undesirably high, more particularly if pipes of large cross-section and small bending radius are to be bent.

SUMMARY OF THE INVENTION

Starting from this prior art, it is an object of the invention to provide a bending mandrel with whose use the pipe is bent without excessive bending force and without flattenings or other undesirable deformations.

This problem is solved according to the invention in a bending mandrel of the kind specified by the feature that except for the lamellae disposed on the outside in the assembly, each of the sheet metal lamellae has a central window-like cutaway portion which so extends longitudinally of the assembly that the lamellae partially register via their narrow edge zones, forming a hollow member.

Although the bending mandrel according to the invention consists of lamellae, due to the selected material (sheet metal) it is stable in shape and can be relatively readily bent, since the central lamellae do not extend over the entire cross-section.

Preferably for the sheet metal of the lamellae a wear-resistant material is selected which has a high modulus of elasticity, a high strength and a low coefficient of friction in relation to the material of the pipe, which is suitably bronze, but more particularly steel, more particularly spring steel.

The bending mandrel can be constructed in different ways.

In a first embodiment the cutaway portion in the cutaway lamellae are open at their unattached ends. In an alternative embodiment the cutaway portion in the cutaway lamellae are closed at their unattached ends. The closed end can be advantageous for supporting the end which might possibly be particularly heavily loaded in practice.

The bending force required for bending can be further reduced by the feature that at least some lamellae have on their side adjacent the inner bending arc notches extending transversely of their longitudinal direction. The bending force can also be reduced by the feature that a sliding means is provided between the individual lamellae sliding on one another.

To facilitate the introduction of the bending mandrel into a pipe, according to a possible feature of the invention the free end of the assembly is rounded off spherically, chamfered at an inclination or converges to a point.

Since the bending mandrel must be introduced into the pipe by its head, it must be adapted to the pipe cross-section. To nevertheless enable the lamellae to be attached as simply as possible to the head, according to a possible feature of the invention on its side adjacent the assembly the head is constructed fork-shaped or comb-like, and a proportion of the lamellae is attached between the tines of the fork or the teeth of the comb, the remaining lamellae being attached to the attached lamellae.

Since during the bending operation the lamellae shift in relation to one another, with the result that the lamella lying on the outer arc is left behind, referred to the plane perpendicular to the pipe axis, in comparison with the lamella lying on the inner arc, support would be lost in that zone unless, according to a further feature of the invention, the lamellae have a stepped differential length such that the lamella on the side with the major bending arc has the greatest length, the lamella on the side with the minor bending arc having the shortest length.

To prevent the springy lamellae from expanding apart, according to another feature of the invention at their free ends the lamellae are held together by a spring attached to the outer lamellae.

As a rule the procedure followed when bending a pipe in a bending device having a bending mandrel is that bending is performed in portions, in which case the bending mandrel must be correspondingly changed in position. In contrast, the invention allows bending in a single operation—i.e., without repositioning the bending mandrel. Accordingly, the invention also relates to a method of bending a pipe, using a bending mandrel according to the invention, in a bending device having a fixed holder for the pipe with the bending mandrel introduced, a supporting member disposed fixed on the side of the minor bending arc, and a guide member for the pipe which can pivot around the centre of the bending arc. Such a method is characterised according to the invention in that the pipe and the bending mandrel used, which extends over the entire length of the bending arc, are axially fixed during the entire bending operation. The method according to the invention is rendered possible since, due to the special construction of the bending mandrel, the bending forces required are relatively low, so that the bending forces to be exerted do not become uncontrollably high, even despite the greater axial length over which the lamellae slide on one another during the bending operation.

If, as in this method, the pipe is retained axially fixed during the bending operation, the effective bending zone moves around the centre of the bending arc during the bending operation. The flexible bending mandrel must therefore be designed with a suitable length. An alternative method according to the invention is effective with a shorter bending mandrel. This method uses a bending device having a fixed holder for the pipe with the bending mandrel introduced, a supporting member disposed on the side of the minor bending arc and more particularly rotatable around the centre of the bending arc, and a guide member for the pipe which can pivot around said centre, Such a method is characterised according to the invention in that the pipe and the bending mandrel used, which extends with its bendable assembly at least over the effective bending zone of the bending arc, are so guided axially freely movable or controlled during the entire bending operation that the bendable assembly of the bending mandrel remains in the effective bending zone.

In this method, to obtain as small a relative movement as possible, the pipe can in a controlled or freely movable manner be adapted, in accordance with its different track speeds on the inner and outer arcs, to the track speeds of the part of the device acting on the pipe. The effective bending zone can be spatially fixed by the axial movement of the pipe, so that the method can be successfully performed with a flexible bending mandrel extending over only a small length of the bending arc.

BRIEF DESCRIPTION OF THE DRAWINGS

The invention will now be explained in greater detail with reference to an embodiment thereof illustrated in the drawings, which show.

DETAILED DESCRIPTION OF THE INVENTION

Figure 1:
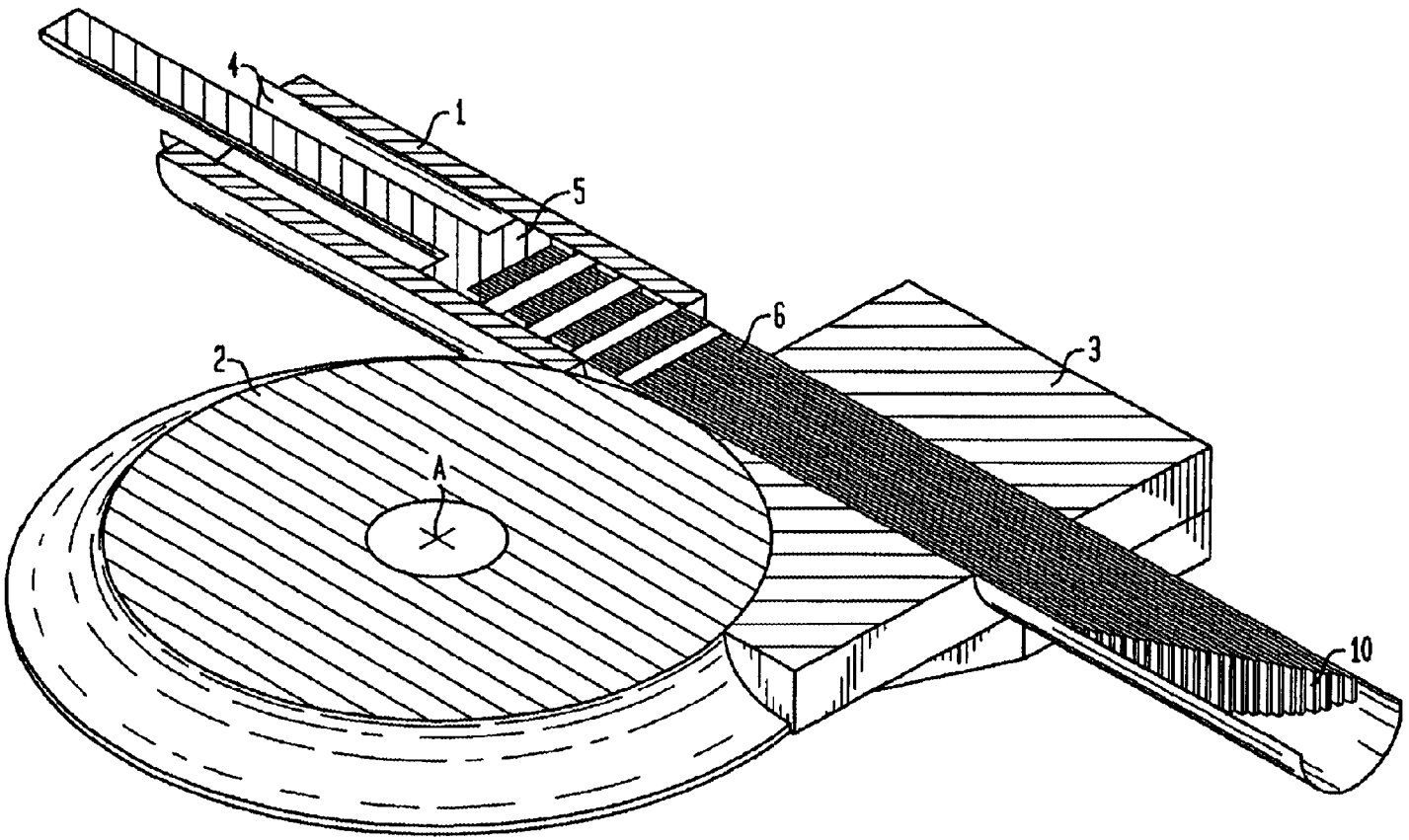
FIG. 1 an isometric semi-section through a bending device with a pipe introduced for bending and the bending mandrel inserted, immediately prior to the bending operation, FIG. 2 a semi-sectional side elevation of the bending device shown in FIG. 1 at the end of the bending operation, FIG. 3 an isometric axial semi-section through a bending mandrel in the bending plane, FIG. 4 an isometric view of the upper half of an assembly of lamellae of the bending mandrel shown in FIG. 3, FIG. 5 an isometric view of the lower half of the assembly of lamellae of the bending mandrel shown in FIG. 3, FIG. 6 a side elevation of a detail of a lamella of the bending mandrel shown in FIG. 3, FIG. 7 an isometric semi-sectional view of an embodiment alternative to FIG. 1 of a bending device with a pipe introduced for bending and the bending mandrel inserted, immediately prior to the bending operation, and FIG. 8 a semi-sectional side elevation of the bending device shown in FIG. 7 at the end of the bending operation.
Figure 2:
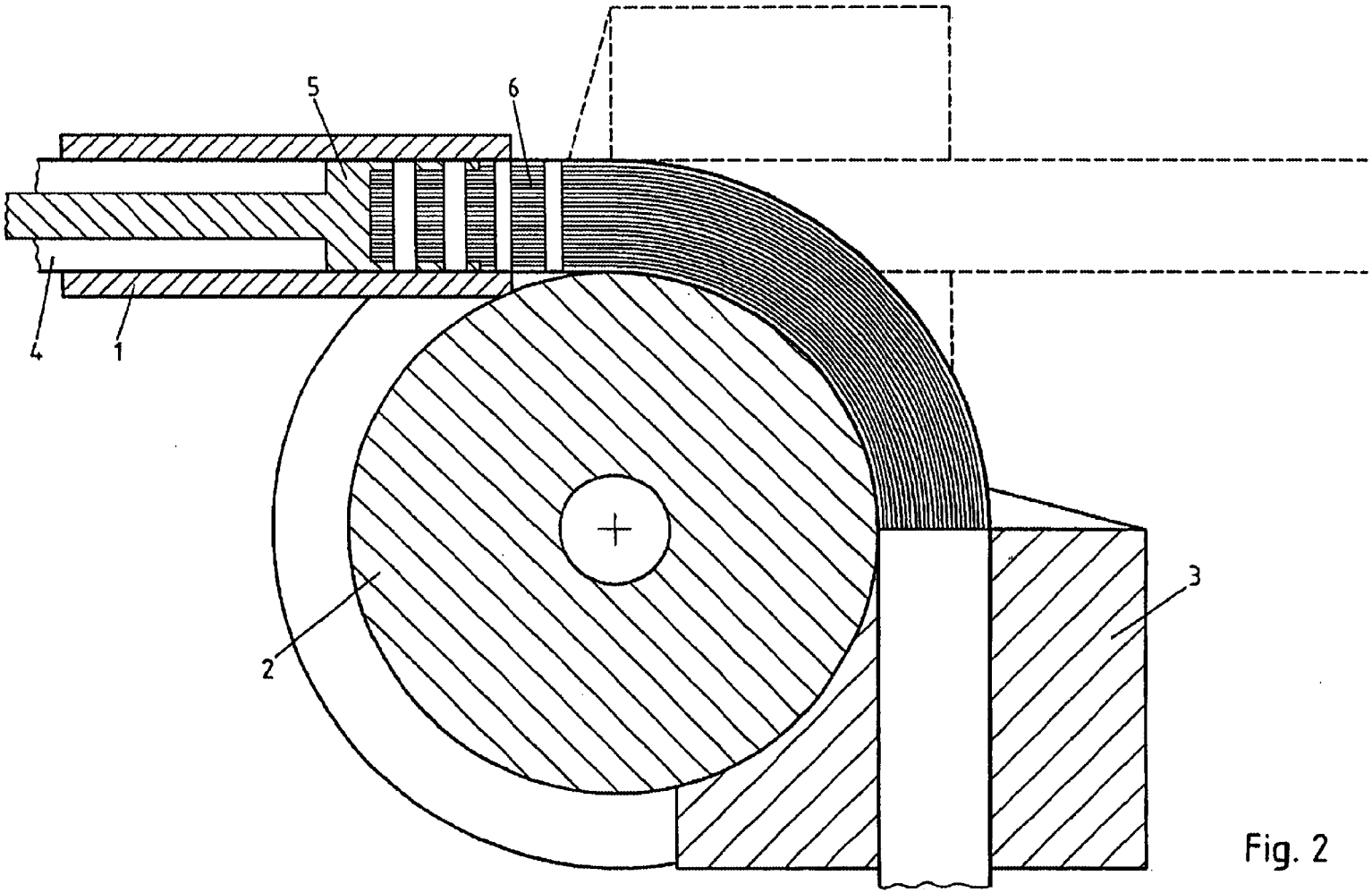
Figure 4:
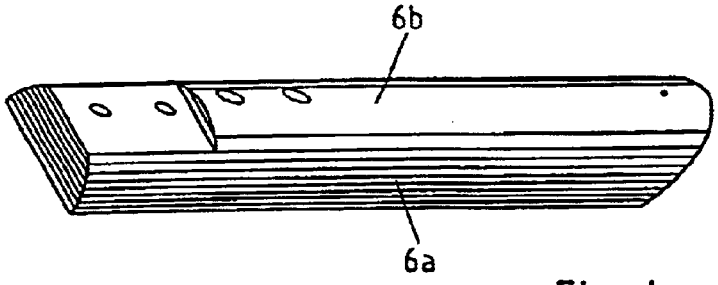

Referring to FIGS. 1 and 2, a bending device comprises a fixed holder 1, a supporting member 2 disposed fixed on the side of the minor bending arc, and a guide member pivotable around centre A of the supporting member 2. In the starting position for the bending operation as shown in FIG. 1 a pipe 4 to be bent is disposed in the holder 1 and extends out beyond the guide member 3. A bending mandrel is inserted in the pipe 4.

Figure 3:
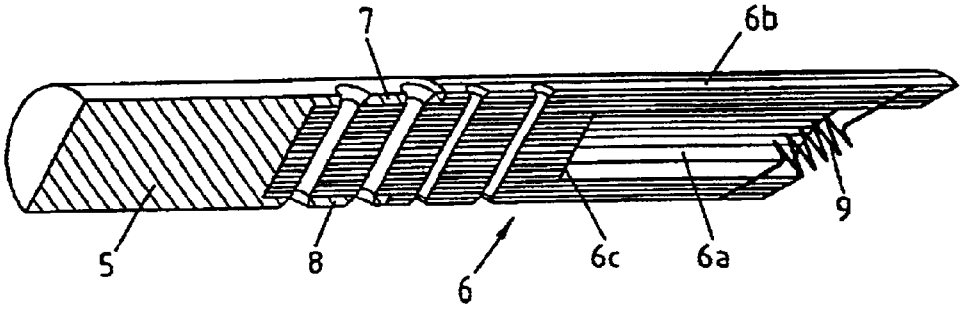
Figure 5:
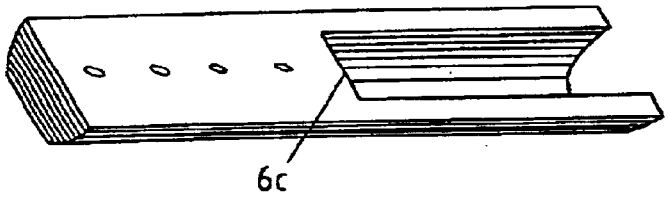
Figure 6:
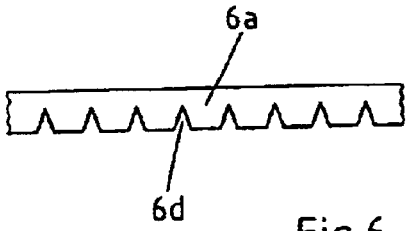

As FIGS. 3 to 6 show, the bending mandrel comprises a rigid head 5 and attached thereto an assembly 6 of lamellae 6*a*, 6*b* layered on one another. To facilitate the introduction of the bending mandrel into the pipe 4, the free end 10 of the assembly may be chamfered at an inclination and converges to a point as shown in FIG. 1. For the attachment of the assembly 6 to the head 5 the head 5 has two fork tines 7, 8. With the exception of the outer, somewhat shortened lamella 6*b*, the lamellae 6*a* are attached by screw bolts between the fork tines 7, 8. The outer lamellae 6*b* are attached by means of screw bolts to the other lamellae 6*a*. With the exception of the outer lamellae 6*b*, the lamellae 6*a* have window-like cutaway portions 6*c* which are open in the direction of the free end of the assembly 6. To simply the drawings, this is shown only in FIGS. 3 and 5. The outer lamellae 6*b* are constructed holohedrally, so that the lamellae 6*a*, 6*b* layered on one another form a hollow member in which the individual lamellae 6*a*, 6*b* register with one another and bear against one another. In the zone of the cutaway portions 6*c* the lamellae 6*a*, 6*b* can have grooves 6*d* extending transversely of the bending plane. The cutaway portions 6*c* and the grooves 6*d* enhance the bendability of the assembly 6. FIG. 3 also shows how at their free end the lamellae 6*a*, 6*b* are held together by a tension spring 9. FIG. 3 also shows how the lamellae 6*a*, 6*b* have a different length. The lamellae shown at the bottom in the drawings, which are situated on the side of the minor bending arc have the shortest length, while the lamellae situated on the opposite side—i.e., on the side of the major bending arc, have a greater length. As a result of this differential length, in the bent state the ends lie substantially in a radial plane of the pivoting axis. This is advantageous for the supporting effect, since with lamellae of equal length an axial offsetting of the ends in relation to one another takes place and therefore the support is partially lost, as shown in FIG. 2.

Figure 7:
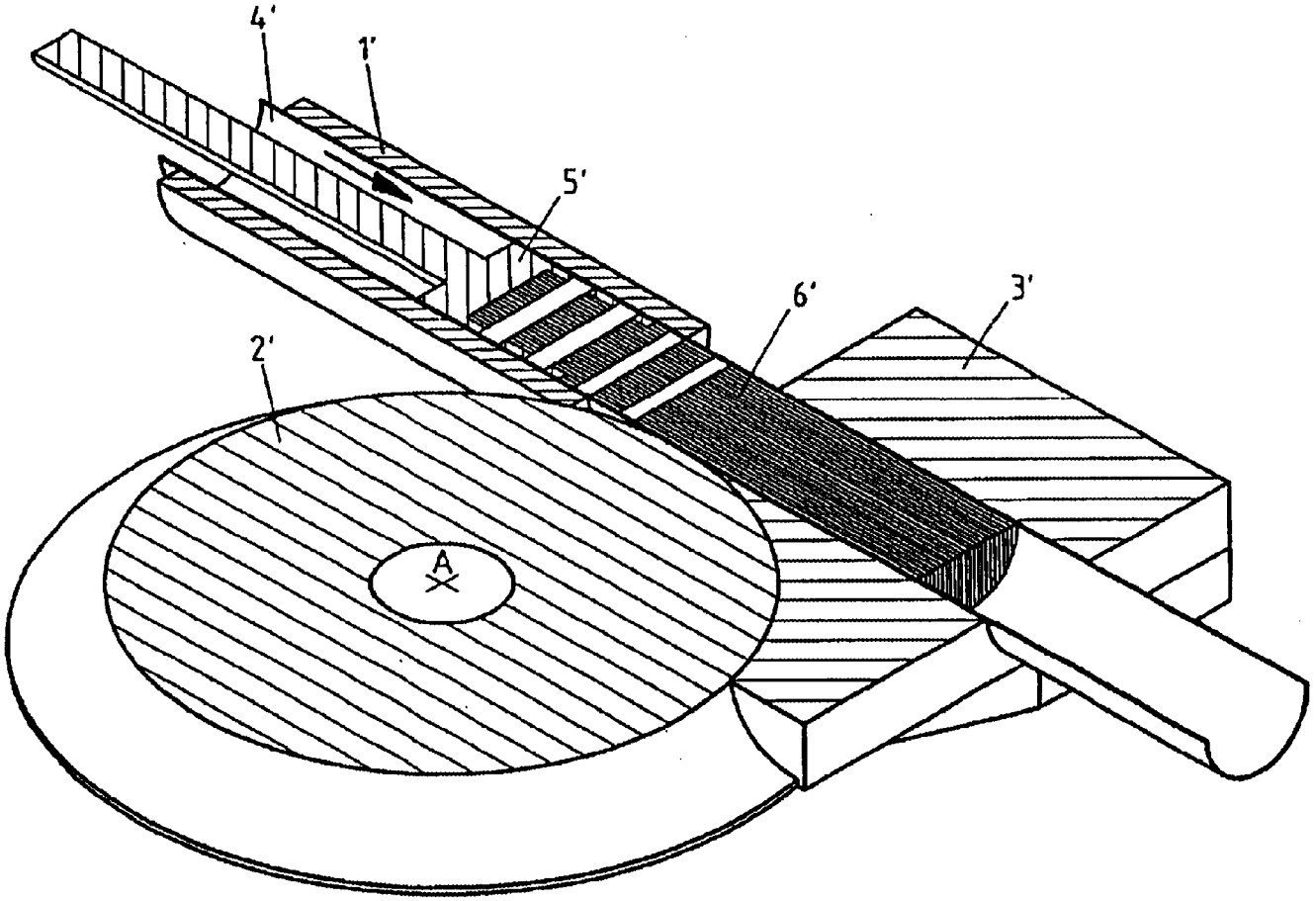
Figure 8:
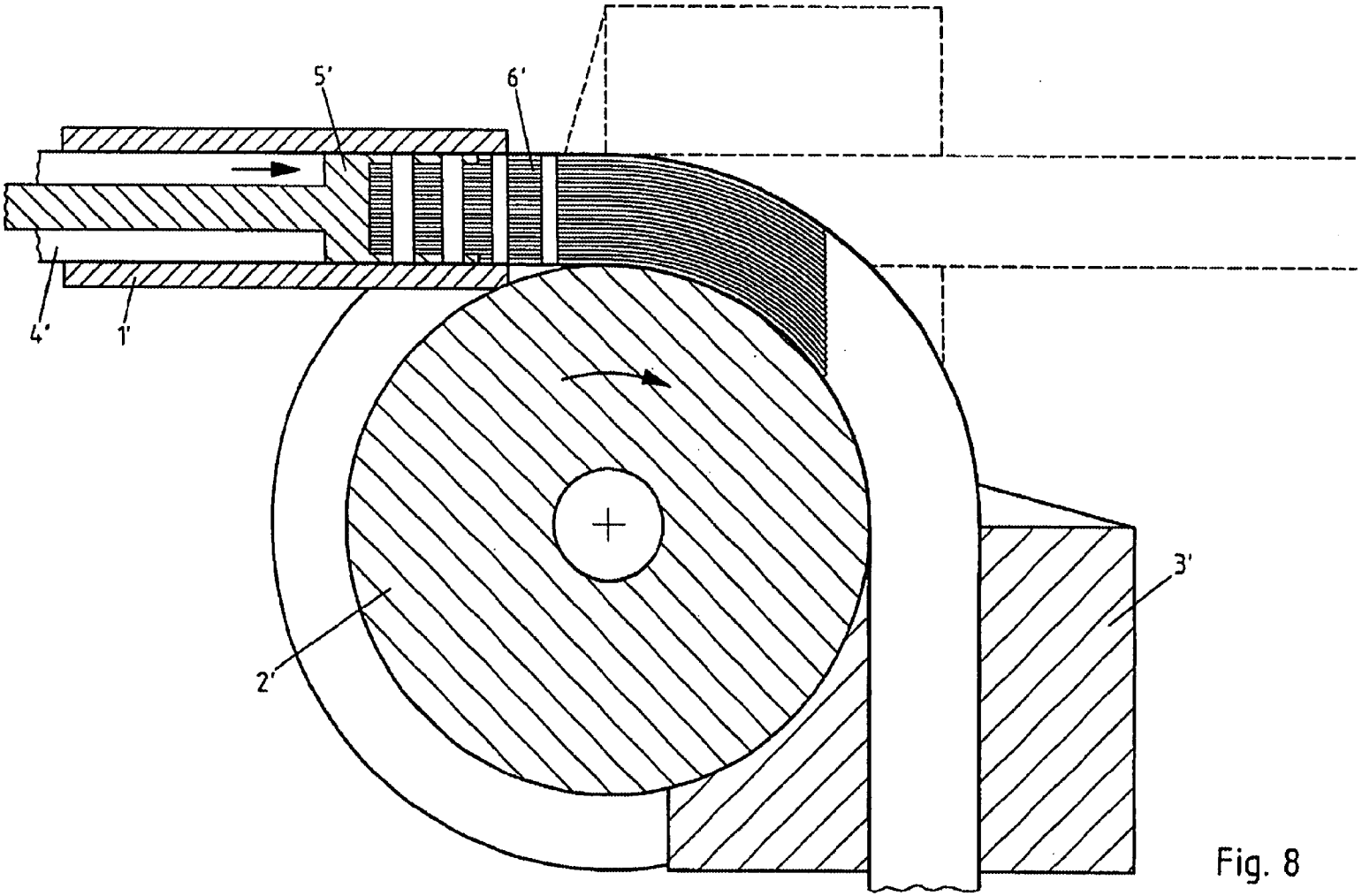

The embodiment illustrated in FIGS. 7 and 8 differs from that shown in FIGS. 1 and 2 by the features that the supporting member 2' is rotatable around the centre A of the bending arc, the pipe 4' is not axially fixed but is readjusted, and the flexible part 6' of the bending mandrel 5', 6' has a comparatively short length.

For a first bending method according to the invention the pipe 4 is retained axially fixed. The supporting member 2 is non-rotatable. The bending mandrel 5, 6 is also axially fixed and its flexible assembly 6 has a length extending over the entire length of the arc of the pipe 4 to be bent, as shown in FIGS. 1 and 2. As a result of such a configuration, during the bending operation the bending mandrel 5, 6 must not be readjusted in accordance with the progress of bending.

Consequently, the method can be simply and rapidly performed, nor does it lead to internal damage to the pipe 4, something which may happen in methods which require the readjustment of the bending mandrel.

In contrast, in a second bending method according to the invention using a device as shown in FIGS. 7 and 8, the bending mandrel 5, 6 must be readjusted in relation to the pipe 4 in accordance with the progress of bending. For this purpose it is retained by its flexible assembly 6' in the operative bending zone of the device—i.e., in the initial portion of the bending arc. The pipe 4' must therefore be readjusted in accordance with the progress of bending. Such readjustment is facilitated by the supporting member 2', which shares the movement. The main advantage of this method is that, due to the short length of the flexible assembly 6' of the bending mandrel 5', the bending force to be exerted is low and the undesirable relative movement between the pipe inner wall and the bending mandrel is limited to the short effective bending zone.

What is claimed is:

1. A bending mandrel for a bending device for a pipe, said bending mandrel comprising:

a rigid head; and an assembly of flexible lamellae made of sheet metal, said assembly of flexible lamellae having an attached end attached to the rigid head and an unattached end, the flexible lamellae in the assembly being arranged one above the other, said lamellae being bendable towards one another perpendicularly to the plane of the lamellae, and being capable of sliding relative to one another, wherein the assembly of flexible lamellae includes inner and outer lamellae, wherein each of the inner lamellae includes a central window-like cutaway portion extending longitudinally of the assembly which collectively define a longitudinally extending hollow zone of the assembly.

2. A bending mandrel according to claim 1, wherein the sheet metal of the flexible lamellae comprises a wear-resistant material selected from the group consisting of steel, spring steel and bronze.

3. A bending mandrel according to claim 1, wherein the central window-like cutaway portions of the inner lamellae are open at an end oriented towards the unattached end of the assembly.

4. A bending mandrel according to claim 1, wherein some of the lamellae side notches extend transversely of the longitudinal direction of the lamellae.

5. A bending mandrel according to claim 1, wherein the unattached end of the assembly is chamfered at an inclination and converges to a point.

6. A bending mandrel according to claim 1, wherein the rigid head is shaped as a fork with tines on its side adjacent to the attached end of the assembly.

7. A bending mandrel according to claim 6, wherein the inner lamellae are attached to the rigid head through the tines of the fork and the outer lamellae are attached to said inner lamellae.

8. A bending mandrel according to claim 1, the flexible lamellae have different lengths, wherein the lamellae are oriented so that when the assembly is bent it forms a major bending arc and a minor bending arc, the longer flexible lamellae being oriented towards the major bending arc and the shorter flexible lamellae being oriented towards the minor bending arc.

9. A bending mandrel according to claim 1, wherein the flexible lamellae are held together at the unattached end by a spring attached to the outer lamellae.

10. A bending device for bending a pipe comprising:

the bending mandrel of claim 1 suitable for introduction into the interior of the pipe;

a fixed holder for supporting the pipe with the bending mandrel in the pipe's interior;

an arcuate supporting member about which the pipe will be bent, said arcuate supporting member having a central axis and being non-rotatable; and a guide member which supports the pipe and cooperates with the arcuate supporting member to cause the pipe to be bent about the arcuate supporting member, wherein the fixed holder, the arcuate supporting member and the guide member hold the pipe and the bending mandrel axially fixed during bending operation.

11. A bending device for bending a pipe comprising:

the bending mandrel of claim 1 suitable for introduction into the interior of the pipe;

a fixed holder for supporting the pipe with the bending mandrel in the pipe's interior;

an arcuate supporting member about which the pipe will be bent during a bending operation, said arcuate supporting member having a central axis and being rotatable about said central axis; and a guide member which supports the pipe and cooperates with the arcuate supporting member to cause the pipe to be bent about the arcuate supporting member, wherein the fixed holder, the arcuate supporting member and the guide member support the pipe and the bending mandrel in such manner that they are freely axially movable during the bending operation.

* * * * *